US008222968B2

(12) United States Patent
Takagi

(10) Patent No.: US 8,222,968 B2
(45) Date of Patent: Jul. 17, 2012

(54) MICROSTRIP TRANSMISSION LINE DEVICE INCLUDING AN OFFSET RESISTIVE REGION EXTENDING BETWEEN CONDUCTIVE LAYERS AND METHOD OF MANUFACTURE

(75) Inventor: Kazutaka Takagi, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 16 days.

(21) Appl. No.: 11/669,975

(22) Filed: Feb. 1, 2007

(65) Prior Publication Data

US 2007/0229188 A1 Oct. 4, 2007

(30) Foreign Application Priority Data

Mar. 29, 2006 (JP) ..... 2006-091726

(51) Int. Cl.
*H01P 1/22* (2006.01)
*H01P 1/24* (2006.01)

(52) U.S. Cl. ..... 333/81 A; 333/128; 333/22 R; 29/610 R; 29/620

(58) Field of Classification Search ..... 333/22 R, 333/81 A, 128, 136; 29/610 R, 620
See application file for complete search history.

(56) References Cited

U.S. PATENT DOCUMENTS 3,541,474 A * 11/1970 Holton ..... 333/22 R
3,947,801 A * 3/1976 Bube ..... 338/308
3,996,551 A * 12/1976 Croson ..... 338/309
4,685,203 A * 8/1987 Takada et al. ..... 29/620
4,835,496 A * 5/1989 Schellenberg et al. ..... 333/128
4,965,538 A * 10/1990 Mickey, III ..... 333/81 A
5,448,208 A * 9/1995 Honjo ..... 333/128
6,903,621 B2 * 6/2005 Malcolm et al. ..... 333/81 A
2005/0196966 A1 * 9/2005 Su et al. ..... 438/700

FOREIGN PATENT DOCUMENTS

EP 0909024 A2 * 9/1998
JP 63-186492 8/1988
JP 01-179353 7/1989
JP 09-275001 10/1997
JP 11-127004 5/1999
JP 11-330813 11/1999
JP 2001-168656 6/2001

* cited by examiner

*Primary Examiner* — Benny Lee

(74) *Attorney, Agent, or Firm* — Oblon, Spivak, McClelland, Maier & Neustadt, L.L.P.

(57) ABSTRACT

A method for manufacturing a microstrip transmission line device includes forming a resistor layer on an insulating or dielectric substrate having a back face where a metal layer to be grounded is provided. The method also includes removing the formed resistor layer except for a part of the formed resistor layer which requires a resistor. Further, the method includes forming a metal conductive layer on the remaining part of the resistor layer. The metal conductive layer contacts the substrate. The method additionally includes removing the formed metal conductive layer at a part required as a resistor except for a part required for connection to the resistor, the parts being included at the remaining part of the resistor layer.

5 Claims, 3 Drawing Sheets

RELATED ART

MICROSTRIP TRANSMISSION LINE DEVICE INCLUDING AN OFFSET RESISTIVE REGION EXTENDING BETWEEN CONDUCTIVE LAYERS AND METHOD OF MANUFACTURE

CROSS-REFERENCE TO RELATED APPLICATIONS

This application is based upon and claims the benefit of priority from prior Japanese Patent Application No. 2006-091726, filed Mar. 29, 2006, the entire contents of which are incorporated herein by reference.

BACKGROUND OF THE INVENTION

1. Field of the Invention

The present invention relates to a microstrip transmission line device, and particularly to a microstrip transmission line device for use in a power distribution/synthesis circuit having a resistor part and a method for manufacturing the microstrip transmission line device.

2. Description of the Related Art

In a microwave circuit such as a Wilkinson circuit used for power distribution/synthesis, a resistor is required at a predetermined position on a line. There is a case that a resistor has to be inserted between a transmission line and a ground in order to prevent oscillation in a microwave circuit (for example, see Jpn. Pat. Appln. Laid-Open Publication No. 11-330813).

If a microwave circuit requires a resistor as described above, the resistor is conventionally formed through process described below. That is, as shown in FIGS. 1 and 2, a resistance layer 3 (FIG. 2) is accumulated on an entire face of an insulating layer 2 (FIG. 2) such as ceramic substrate having a back face provided with a ground layer 1 (FIG. 2). A metal conductive layer 4 is accumulated on the resistance layer 3.

Next, as shown in FIGS. 3 and 4, a part of the metal conductive layer 4 provided on the resistance layer 3 is removed by etching or the like. Further, as shown in FIGS. 5 and 6, an unnecessary region is removed from the resistance layer 3. At this time, a necessary region of the resistance layer 3 is left intact, thereby forming a resistor 5.

Paying attention to a conductive region 7 thus formed, the region 7 (FIG. 5) has a structure as shown in FIG. 7. That is, as a microstrip line, an electromagnetic wave is generated between the ground layer 1 provided on a back face of the insulating layer 2 and the metal conductive layer 4, allowing a line of electric force 8 to pass through the resistance layer 3.

If the operating frequency is low, existence of the resistance layer 3 provided under the metal conductive layer 4 does not substantially cause any serious problem. However, if the operating frequency is so high like in case of a microwave, the resistance layer 3 under the metal conductive layer 4 has a rather larger electric power distribution than the metal conductive layer 4, causing transmission loss to increase in the resistance layer 3.

SUMMARY OF THE INVENTION

According to one aspect of the invention, there is provided a microstrip transmission line device including a substrate, a resistor layer, and a metal conductive layer. The substrate is made of an insulating or dielectric material and has a back face where a metal layer to be grounded is provided. The resistor layer is provided at a region on the substrate which requires a resistor. The metal conductive layer is provided on the substrate and connected to the resistor layer.

BRIEF DESCRIPTION OF THE DRAWINGS

In the accompanying drawings, like reference numbers represent like parts, and may not be described in detail for all drawing figures.

DETAILED DESCRIPTION OF THE INVENTION

An embodiment of the present invention will now be described below with reference to the drawings.

The embodiment below will be described with respect to an exemplary case of a Wilkinson circuit used for power distribution/synthesis. The following description will be made only of a region where a resistor is formed.

FIGS. 8 to 13 show manufacturing process in an example of a method for manufacturing a microstrip transmission line device according to the embodiment of the present invention.

Figure 1:
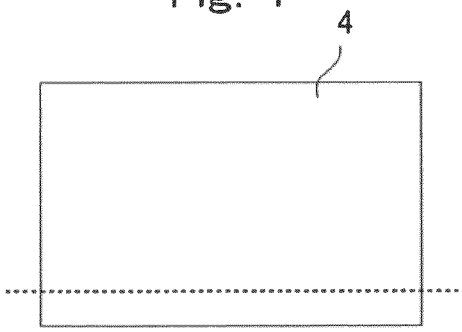
FIG. 1 is a plan view showing a first step of manufacturing process in a conventional method for manufacturing a microstrip transmission line device.
Figure 2:
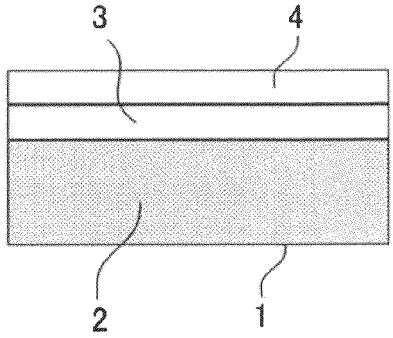
RELATED ART Fig. 2
FIG. 2 is a cross-sectional view of the first step.
Figure 3:
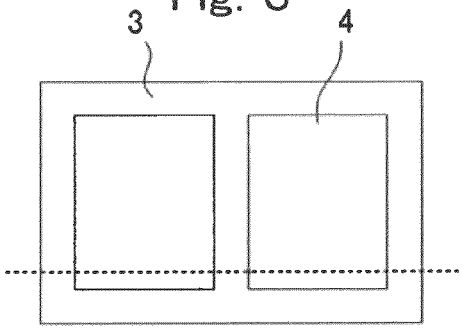
RELATED ART Fig. 3
FIG. 3 is a plan view showing a second step of manufacturing process in the conventional method for manufacturing a microstrip transmission line device.
Figure 4:
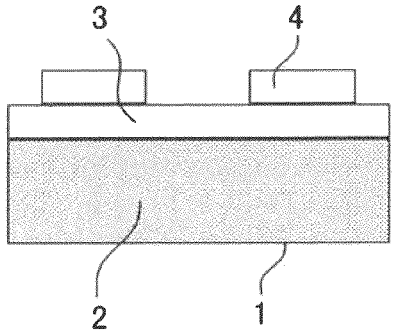
RELATED ART Fig. 4
FIG. 4 is a cross-sectional view of the second step.
Figure 5:
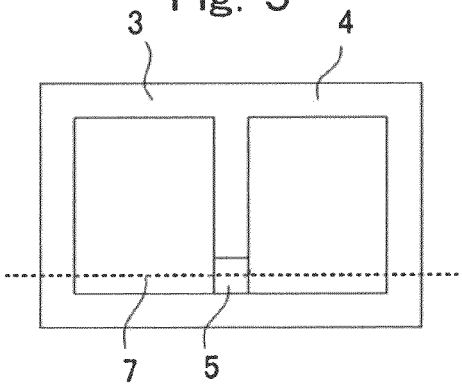
RELATED ART Fig. 5
FIG. 5 is a plan view showing a third step of manufacturing process in the conventional method for manufacturing a microstrip transmission line device.
Figure 6:
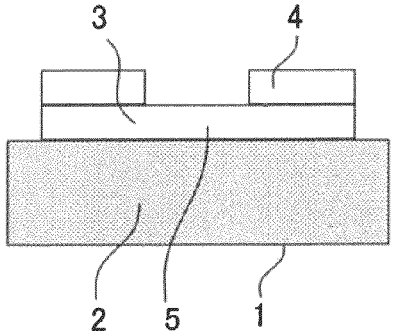
RELATED ART Fig. 6
FIG. 6 is a cross-sectional view of the third step.
Figure 7:
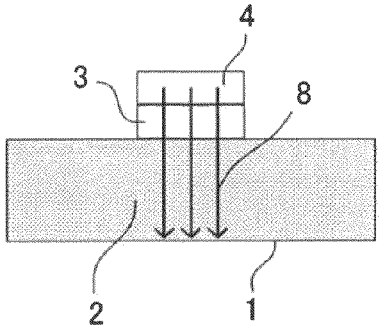
FIG. 7 is a view for describing a problem in a structure of a conventional microstrip transmission line device.
Figure 8:
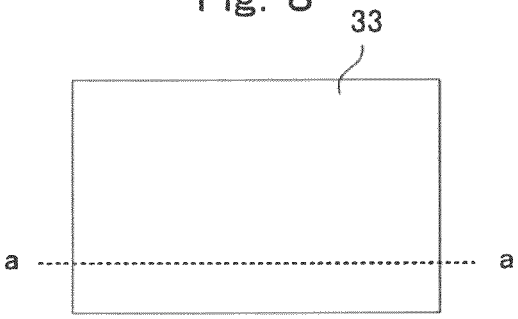
RELATED ART Fig. 8
FIG. 8 is a plan view showing a first step of manufacturing process in a method for manufacturing a microstrip transmission line device, according to an embodiment of the invention.
Figure 9:
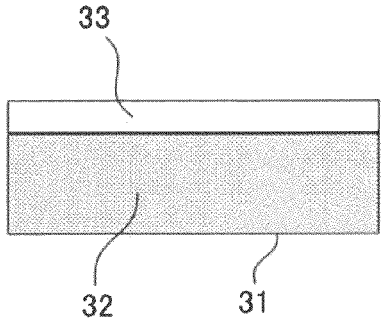
FIG. 9 is a cross-sectional view showing an example of the first step.

FIG. 9 is a cross-sectional view cut along a broken line a-a in FIG. 8. As shown in FIG. 9, a resistance layer 33 (FIG. 8) formed of, for example, tantalum nitride ($Ta_2N$) is vapor-deposited to have a predetermined thickness, e.g., 1 μm on a insulating substrate 32. The insulating substrate 32 is ceramic substrate which is 100 μm thick and has a metal layer 31 provided on an entire back face of the substrate by vapor-depositing, for example, gold (Au).

Figure 10:
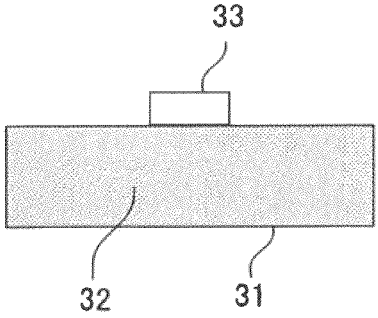
FIG. 10 is a cross-sectional view showing a second step of manufacturing process in the method for manufacturing a microstrip transmission line device.

Next, as shown in FIG. 10, a predetermined pattern is formed by etching the resistance layer 33. Other regions than a region which requires a resistor and a part to be connected to a metal conductive layer described later are removed. Next, as shown in FIG. 11, for example, gold is accumulated to a predetermined thickness of 4 μm thereby to form the metal conductive layer 34 on the insulating substrate 32 where the resistance layer 33 having the predetermined pattern is provided.

Figure 11:
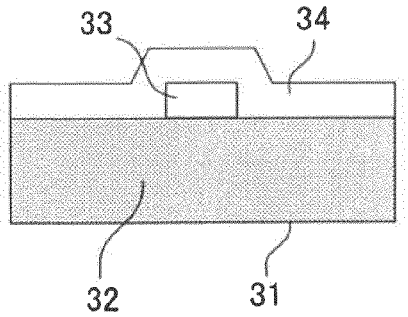
FIG. 11 is a cross-sectional view showing an example of the third step in the method.
Figure 12:
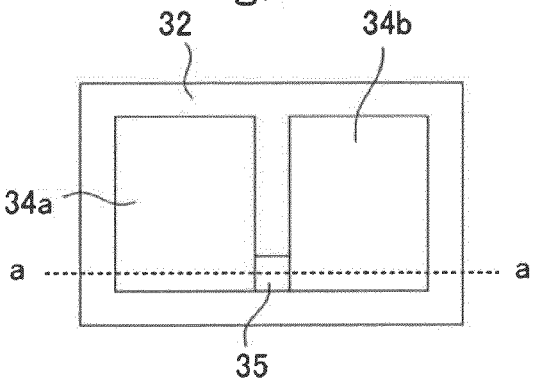
FIG. 12 is a plan view showing a fourth step of manufacturing process in the method for manufacturing a microstrip transmission line device.
Figure 13:
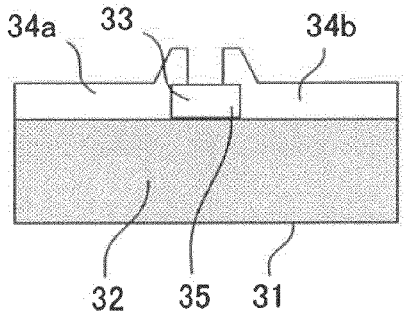
FIG. 13 is a cross-sectional view along reference line "a-a" of FIG. 12, showing an example of the fourth step in the method, and showing an example of a microstrip transmission line device according to the embodiment.

Next, as shown in FIGS. 12 and 13, the metal conductive layer 34 of FIG. 11 is selectively etched thereby to obtain a structure in which a resistor part 35 is connected between regions 34*a* and 34*b* of the metal conductive layer having a desired pattern. FIG. 12 shows that the regions 34*a* and 34*b* are larger than the resistor part 35 as well as that the resistor part 35 is offset from the center of the regions 34*a* and 34*b*.

In the microstrip transmission line device formed as described above, the resistance layer 33 (FIG. 13) is formed only on such a region on the insulating substrate 32 that requires a resistor. Immediately under the metal conductive layer in the regions 34*a* and 34*b* formed as parts of the microstrip transmission line, there is no resistor layer except for a part necessary for connecting the regions 34*a* and 34*b* to the resistor part 35. Therefore, when the device functions as a transmission line, a line of electric line force extending from the metal conductive layer reaches the metal layer 31 (FIG. 13) on the back face from the insulating substrate via no resistor layer. As a result, loss can be reduced.

Although the above embodiment uses ceramic substrate as the insulating substrate 32, a dielectric substrate such as a glass epoxy substrate can be used as an insulating substrate.

Also in the above embodiment, a resistor layer is provided first on a substrate as shown in FIG. 13, and then, a metal conductive layer is provided on the resistor layer.

Figure 14:
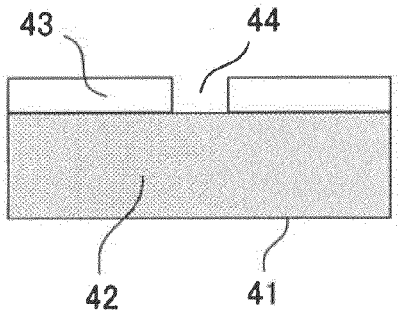
FIG. 14 is a cross-sectional view showing a first step of manufacturing process in a method for manufacturing a microstrip transmission line device, according to another embodiment of the invention.
Figure 15:
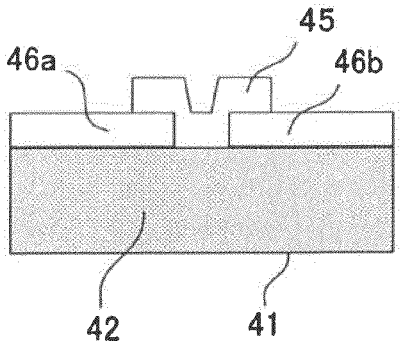
FIG. 15 is a cross-sectional view showing an example of a second step in the method according to the embodiment, and showing an example of a microstrip transmission line device according to another embodiment of the invention.

However, a metal conductive layer can be provided first, and then, a resistor layer can be provided. FIGS. 14 and 15 show exemplary manufacturing process in a method for manufacturing a microstrip transmission line device according to another embodiment.

Specifically, as shown in FIG. 14, a metal conductive layer 43 is provided by vapor-deposition on an upper surface of an insulating substrate 42 having a back face where a metal layer 41 is provided. Thereafter, unnecessary regions and a region 44 (corresponding to a part which functions as a resistor) where a resistor is to be formed are removed by etching. Thereafter, a resistor layer is vapor-deposited thereon. As shown in FIG. 15, other regions than the region 44 in FIG. 15 for forming a resistor and a part to be connected to the metal conductive layer 43 are removed by etching, thereby to form a resistor part 45. In this manner, a structure in which a resistor is connected between microstrip lines 46*a* and 46*b* having a desired pattern is obtained.

According to the structure of the microstrip transmission line device of this embodiment, even if regions where the microstrip lines 46*a* and 46*b* overlap the resistor part 45 are formed relatively large, transmission loss is small at the overlapping region. This is because, in case of a high frequency wave such as a microwave, a line of electric force extending toward a grounded face provided below the microstrip lines does not pass through the resistor part 45. By forming relatively large overlapping regions, bonding between the microstrip lines 46*a* and 46*b* and the resistor part 45 can be improved.

The above description, a microstrip transmission line device having a resistor has been described. The present invention can be applied to a capacitor having a resistor therebetween.

The above description has been made with respect to a case of applying the present invention to a Wilkinson circuit used for power distribution/synthesis. However, the invention is not limited to this circuit. For example, the invention is applicable to a microwave device in which plural transistors are provided.

The invention is not limited to the embodiments described above but can be variously modified in practice within the scope of technical ideas of the invention.

What is claimed is:

1. A method for manufacturing a microstrip transmission line device, comprising:

forming a metal conductive layer on a front face of an insulating or dielectric substrate having a metal layer on a back face;

removing a region of the metal conductive layer to produce a remaining part of the metal conductive layer on the insulating or dielectric substrate and to produce, on the insulating or dielectric substrate, a removed region corresponding to the region of the metal conductive layer;

forming a resistor layer on the remaining part of the metal conductive layer and on the removed region, the resistor layer contacting the insulating or dielectric substrate at the removed region; and removing the resistor layer except for a region of the resistor layer at the removed region and a part of the resistor layer connected to the metal conductive layer.

2. A method for manufacturing a microstrip transmission line device, comprising:

forming a resistor layer on an insulating or dielectric substrate having a back face where a metal layer to be grounded is provided;

removing the formed resistor layer except for a part of the formed resistor layer which requires a resistor;

forming a metal conductive layer on the remaining part of the resistor layer, the metal conductive layer contacting the substrate; and removing the formed metal conductive layer at a part required as a resistor except for a part required for connection to the resistor, the parts being included at the remaining part of the resistor layer.

3. A microstrip transmission line device, comprising:

an insulating or dielectric substrate having an upper face, and a back face on which a grounded metal layer is provided;

a resistor layer provided at a region which requires a resistor on the upper face of the insulating or dielectric substrate, the grounded metal layer covering an entirety of a face of the resistor layer nearest the insulating or dielectric substrate, the resistor layer having an upper face furthest from the upper face of the insulating or dielectric substrate, a first end face perpendicular to the upper face of the resistor layer, and a second end face perpendicular to the upper face of the resistor layer, the second face opposing the first end face; and a metal conductive layer provided at a region which requires a conductive region on the upper face of the insulating or dielectric substrate and including a first region and a second region connected to the resistor layer, the first region covering an entirety of the first end face of the resistor layer, the second region covering an entirety of the second end face of the resistor layer, the first and second regions of the metal conductive layer being larger than the resistor layer, the resistor layer being offset from a center of the first and second regions of the metal conductive layer, wherein the metal conductive layer is further provided on the insulating or dielectric substrate without the resistor layer inserted between the metal conductive layer and the insulating or dielectric substrate except at the first region and the second region for connecting the resistor layer and the metal conductive layer.

4. The microstrip transmission line device according to claim 3, wherein the resistor layer is tantalum nitride.

5. The microstrip transmission line device according to claim 3, wherein the first and second regions of the metal conductive layer are substantially greater than as the resistor layer.

* * * * *